US006044873A

United States Patent [19]

Miller

[11] Patent Number: 6,044,873

[45] Date of Patent: Apr. 4, 2000

[54] ONBOARD REFUELING VAPOR RECOVERY DETECTOR

[75] Inventor: Zane A. Miller, 410 E. 63rd Ter., Kansas City, Mo. 64110

[73] Assignee: Zane A. Miller, Kansas City, Mo.

[21] Appl. No.: 09/227,142

[22] Filed: Jan. 8, 1999

[51] Int. Cl.[7] ..... B65B 31/00

[52] U.S. Cl. ..... 141/59; 141/46; 141/98; 141/198; 141/DIG. 1

[58] Field of Search ..... 141/46, 59, 98, 141/198, 302, 307, 308, 392, 206–229, DIG. 1

[56] References Cited

U.S. PATENT DOCUMENTS

| | | | |
|---|---|---|---|
| 3,913,633 | 10/1975 | Hiller | 141/59 |
| 3,941,168 | 3/1976 | Hiller et al. | 141/46 |
| 3,952,781 | 4/1976 | Hiller et al. | 141/46 |
| 3,981,334 | 9/1976 | Deters | 141/46 |
| 3,981,335 | 9/1976 | Deters | 141/46 |
| 4,057,085 | 11/1977 | Shihabi | 141/59 |
| 5,476,125 | 12/1995 | Mitchell | 141/59 |
| 5,782,275 | 7/1998 | Hartsell, Jr. et al. | 141/94 |

OTHER PUBLICATIONS

Aspirator–Assist® by Red Jacket, "Your Answer to Stage II Vapor Recovery," 2 pages, prior to Jan. 8, 1999.

*Primary Examiner*—Steven O. Douglas
*Assistant Examiner*—Khoa D. Huynh
*Attorney, Agent, or Firm*—Shook, Hardy & Bacon LLP

[57] ABSTRACT

An apparatus is provided for detecting the presence of a vehicle equipped with an onboard refueling vapor recovery system. The apparatus has a body that is equipped with an inlet fluid port and an outlet fluid port that is in fluid communication with the inlet fluid port. The body also has an inlet vapor port that is in fluid communication with the outlet fluid port. The apparatus further includes a vacuum chamber that is located within the body, and that is in fluid communication with the vapor port and the outlet port. The apparatus has a vaccum activated detecting switch coupled to the body that is in fluid communication with the vacuum chamber. A vacuum-generating nozzle is coupled within the body between the inlet port and the vacuum chamber. Fuel may be provided to the inlet port and routed through the nozzle to create a vacuum within the chamber. The vapor port may be coupled to a vapor return line, and the switch can be adjusted to detect the pressure difference occurring when air is returned through the vapor port rather than fuel vapor. This sensed difference can then be used to adjust the operation of a Phase II vapor recovery system.

12 Claims, 4 Drawing Sheets

ONBOARD REFUELING VAPOR RECOVERY DETECTOR

STATEMENT REGARDING FEDERALLY SPONSORED RESEARCH OR DEVELOPMENT

Not applicable.

CROSS-REFERENCE TO RELATED APPLICATIONS

Not applicable.

BACKGROUND OF THE INVENTION

The present invention relates to vacuum or pressure detectors. More particularly, the invention is directed to a detector and method for sensing a vehicle equipped with an onboard refueling vapor recovery system.

Gasoline gives off large amounts of vapor, caused by evaporation. This vapor contaminates the air and contributes to the formation of ground-level ozone. This ground-level ozone is caused by volatile organic compounds (VOCs) contained within the vapor of the gasoline. To combat these problems, the United States has mandated both a Phase I and a Phase II vapor recovery process.

Phase I vapor recovery is used during the refueling of gasoline storage tanks, such as at retail gasoline stations, to reduce hydrocarbon emissions. As shown in FIG. 1, Phase I therefore deals with the transfer of fuel from a delivery tanker 10 to an underground storage tank 12 of the gas station. Prior to the installation of Phase I vapor recovery systems, when a delivery truck transferred fuel to a storage tank at a gas station, the new fuel entering the storage tank would force accumulated gasoline vapors out of the tank and into the air, causing ground-level ozone. With a properly functioning Phase I vapor recovery system in place, each gallon of fuel transferred from the delivery tanker 10 into the storage tank 12 displaces a gallon of vapor. As shown in FIG. 1, this gallon of vapor is forced out of the underground storage tank 12 and back into the delivery truck 10 through a vapor recovery line 14. The recovered vapors in the tanker truck 10 can then be recycled and thus the emission of VOCs is reduced.

Phase II vapor recovery deals with refueling vehicles at the gas station. The same concepts apply to Phase II as to Phase 1. More specifically, when gasoline is delivered from the storage tank 12 at the gas station into the gas tank of a vehicle 16, accumulated gasoline vapors within the gas tank will be displaced by the fuel going into the tank. Phase II systems utilize a specially designed nozzle and hose system. Both the nozzle and hose have two passage-ways. As seen in FIG. 2, one passageway 18 is used to deliver gasoline to the vehicle 16 and the other passageway 20 is used for returning vapors from the vehicle fuel tank to the storage tank 12 of the gas station. As gasoline is pumped into the vehicle, vapors are forced out of the automobile fuel tank and through the vapor return hose back into the storage tank. There are now many locations which have installed Phase II vapor recovery systems.

The desire to reduce hydrocarbon emissions has been taken a step further. Federally mandated automobile-based controls for refueling emissions, onboard refueling vapor recovery (ORVR) systems, were introduced with many 1998 model year passenger vehicles. In a typical ORVR design, shown schematically in FIG. 3, the gasoline tank 22 of the vehicle 16 is provided with a narrow fill pipe 24. Fill pipe 24 narrows significantly from the nozzle inlet 26 to an interface 28 with the fuel tank. This narrowing allows for the formation of a continuous liquid seal as gasoline is pumped into the tank. This continuous liquid seal prevents hydrocarbon vapors from escaping the fuel tank while fuel is pumped into the tank. The vapors displaced by the addition of fuel into the tank are forced through a vent 30 connected to the tank 22. The vent 30 is then connected to a canister 32 that contains activated carbon. The carbon in the canister 32 captures and temporarily stores the hydrocarbon vapor. The ORVR vehicle is also equipped with a purge system which meters these captured hydrocarbon vapors to the vehicle engine as fuel. Typically, the purging process is completed with 30 miles of driving.

A difficulty has arisen that stems from the fact that the Phase II vapor recovery systems were designed for vehicles which were not equipped with ORVR systems. In other words, the Phase II vapor recovery systems are equipped to pull the vapors from the vehicle fuel tank into the facility storage tank. Therefore, the Phase II vapor recovery systems are designed to work with non-ORVR vehicles. A problem has arisen when a vehicle equipped with an ORVR system is presented to a facility having a Phase II recovery system. When a vehicle equipped with an ORVR system tries to fuel at a station equipped with a Phase II recovery system, the Phase II recovery system will attempt to pull vapor from the vehicle fuel tank. However, the ORVR system is designed to prevent the flow of vapors from the vehicle fuel tank by the formation of the continuous liquid seal. In the way that the typical ORVR system is designed, the ORVR system will thus not allow the Phase II recovery system to pull vapor from the vehicle fuel tank and vapor will be prevented from leaving the vehicle fuel tank.

When a Phase II vapor recovery system is designed, it is balanced so that the hydrocarbon vapor is pulled from the vehicle fuel tank at a rate equal to that at which fuel is being put into the system. When the Phase II vapor recovery system is prevented from pulling vapor from a vehicle fuel tank, one of two things will happen. In one instance, the Phase II vapor recovery system will continue to operate and will pull air rather than hydrocarbon vapor into the system. This air is lighter than the hydrocarbon vapor. Therefore, when air is being pulled into the facility storage tank instead of hydrocarbon vapor, a greater volume of air per timed unit is introduced into the system as compared to the volume of hydrocarbon vapor. This leaves the system out of balance and the greater volume of air increases the pressure in the underground storage tank. This increased pressure leads to fugitive omissions of hydrocarbon vapor. These emissions can occur in a variety of places due to the increased pressure, such as a vent pipe, and/or leaks through the tank top due to inadequate tank-top tightness. Therefore, if the Phase II vapor recovery system pulls air rather than hydrocarbon vapor, the basic goal of the system is defeated. More specifically, by pulling air into the underground storage tank, the pressure within the tank is increased and fugitive omissions of hydrocarbon vapor are released.

In a second instance, rather than pulling air through the system as opposed to hydrocarbon vapor, the system may merely shut off at the nozzle. This prevents the fuel dispensing nozzle from operating and is thus aggravating to the consumer. In this second instance, the consumer will be prevented from refueling his or her vehicle at the gas station merely because they have presented a vehicle having an ORVR system to a dispenser equipped with a Phase II vapor recovery system.

The above-described problems will continue as long as Phase II vapor recovery systems are present along with vehicles that are equipped with an ORVR system. Therefore, a detector is needed that can sense the presence of an ORVR equipped vehicle at the site having a Phase II vapor recovery system. Further, a method is needed that easily allows the detection of an ORVR equipped vehicle at a gas station having a Phase II vapor recovery system.

BRIEF SUMMARY OF THE INVENTION

It is an object of the present invention to provide a detector that senses the presence of a vehicle having an onboard refueling vapor recovery system.

It is a feature of this invention to provide a detector of simple construction that increases the ability to control hydrocarbon tank top fugitive emissions and prevent the release of harmful hydrocarbon tank vent vapor.

It is a further object of the invention to provide a detector which is compatible with all dispensers and hose configurations currently in use.

It is yet another object of the invention to provide a detector which senses the presence of an ORVR equipped vehicle and which can signal the Phase II vapor recovery system at a dispenser to immediately adjust and compensate for an ORVR equipped vehicle.

According to the present invention, the foregoing and other objects are attained by an apparatus for detecting the presence of a vehicle equipped with an onboard refueling vapor recovery system. The apparatus has a body that is equipped with an inlet fluid port and an outlet fluid port that is in fluid communication with the inlet fluid port. The body also has an inlet vapor port that is in fluid communication with the outlet fluid port. The apparatus further includes a vacuum chamber that is located within the body, and that is in fluid communication with the vapor port and the outlet port. The apparatus has a vacuum-activated switch coupled to the body that is in fluid communication with the vacuum chamber. A vacuum-generating nozzle is coupled within the body between the inlet port and the vacuum chamber. Fuel may be provided to the inlet port and routed through the nozzle to create a vacuum within the chamber. The vapor port may be coupled to a vapor return line, and the switch can be adjusted to detect the pressure difference occurring when air is returned through the vapor port rather than fuel vapor. This sensed difference can then be used to either adjust the operation of a Phase II vapor recovery system.

Additional objects, advantages, and novel features of the invention will be set forth in part in the description which follows, and in part will be apparent to those skilled in the practice of the invention. The object and advantages of the invention may be realized and attained by means of the instrumentalities and combinations particularly pointed out in the appended claims.

BRIEF DESCRIPTION OF THE SEVERAL VIEWS OF THE DRAWINGS

In the accompanying drawings which form a part of this specification and which are to be read in conjunction therewith and in which like reference numerals are used to indicate like parts in the various views.

DETAILED DESCRIPTION OF THE INVENTION

Figure 1:
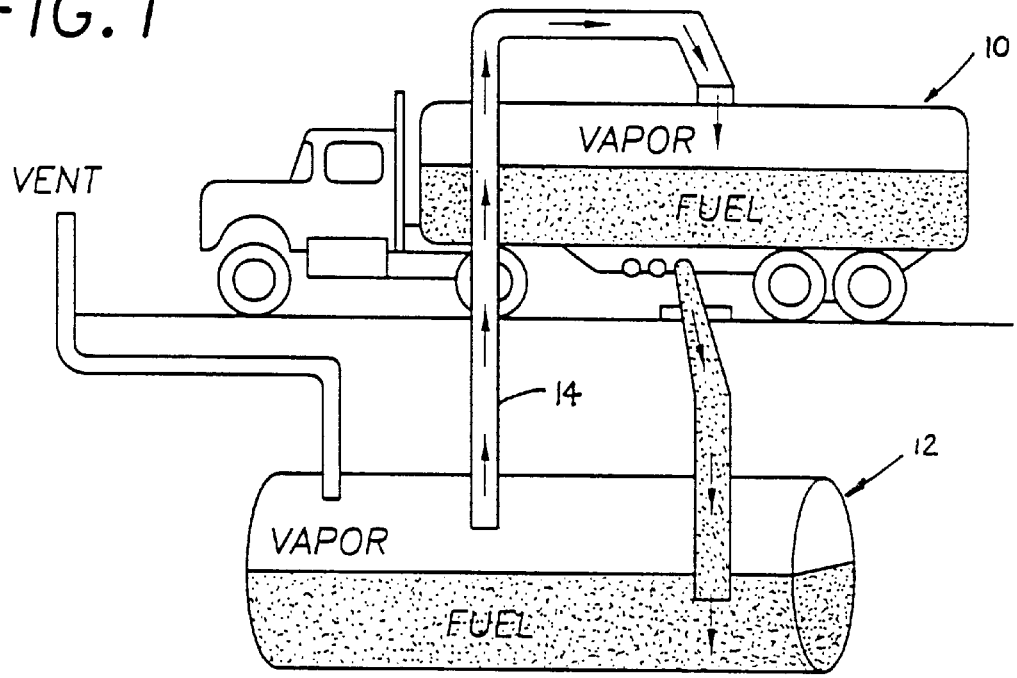
FIG. 1 is a schematic illustrating a prior art Phase I vapor recovery system.
Figure 2:
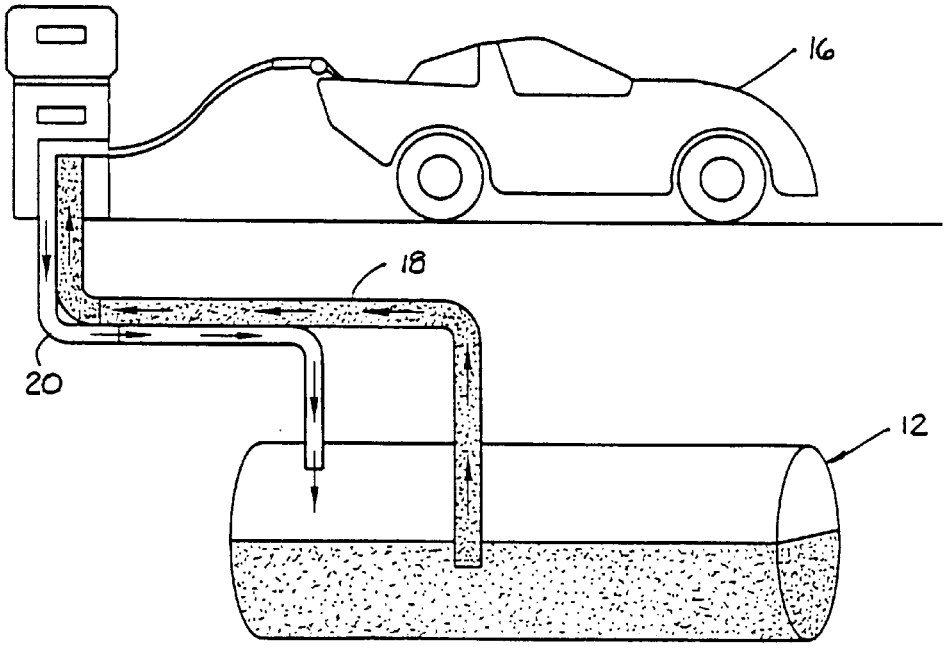
FIG. 2 is a schematic illustrating a prior art Phase II vapor recovery system.
Figure 3:
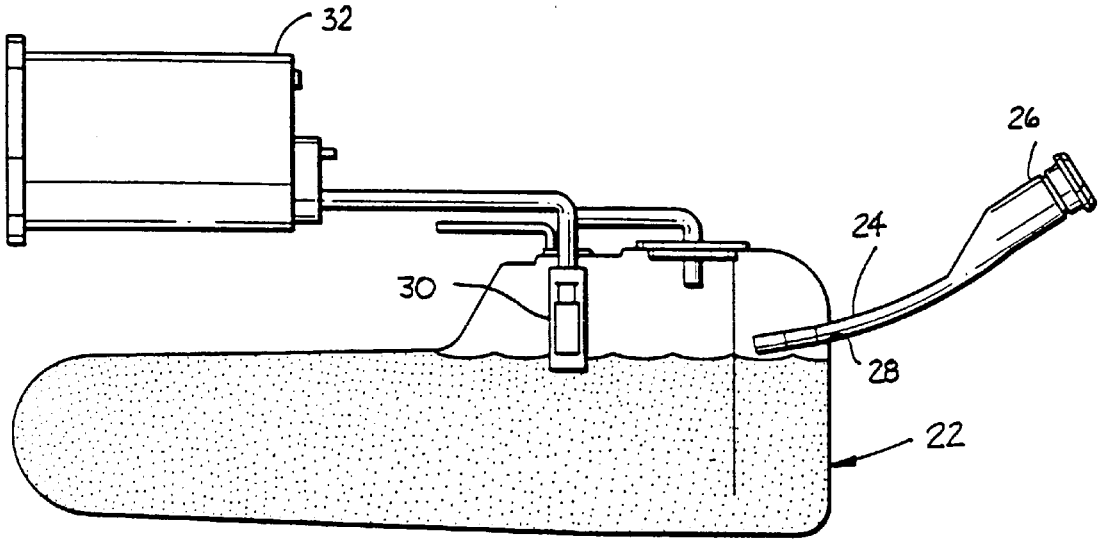
FIG. 3 is a schematic of a typical onboard refueling vapor recovery system.
Figure 4:
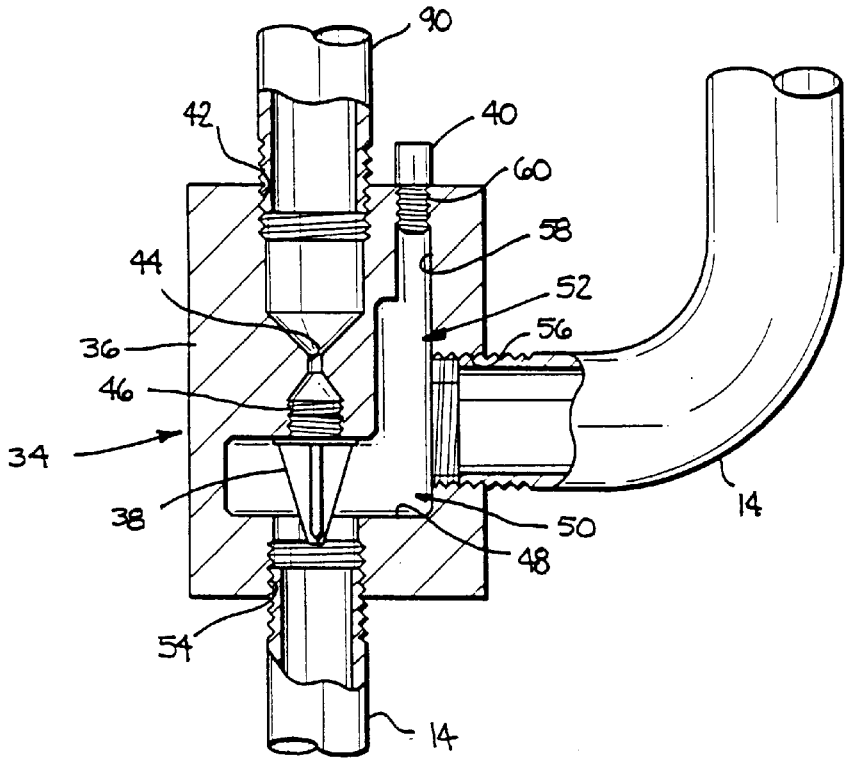
FIG. 4 is a cross-sectional view of a detector according to the present invention.

A sensor for detecting the presence of an ORVR equipped vehicle is broadly designated in the drawings by the reference numeral 34. Sensor 34 has a main body 36, a vacuum generating nozzle 38 and a vacuum-activated switch 40. As best seen in FIG. 4, body 36 has a fluid inlet port 42 formed in the upper portion thereof. Inlet 42 is preferably a cylindrical bore that allows access to the interior of body 36, and is preferably threaded to allow the coupling of body 36 to a fluid inlet source. The passageway or bore of inlet 42 narrows to a throat 44 that is generally in the middle portion of body 36. Throat 44 is a smaller bore that allows communication between inlet 42 and a nozzle port 46. Port 46 is preferably a cylindrical bore that is smaller than inlet 42 and larger than throat 44. The lower end of port 46 is threaded to allow nozzle 38 to be received therein, as is more fully described below. The lower-most edge of port 46 opens to a vacuum chamber 48 located within body 36 and which has a lower section 50 and an upper section 52.

Sections 50 and 52 are generally orthogonal to one another and are in fluid communication with one another. Section 50 extends laterally away from section 52 and beyond nozzle port 46 in one direction and extends laterally to section 52 in the other direction. Section 50 transitions, on one area of its upper edge, to port 46 and has a fluid and vapor outlet port 54 coupled to one area of its lower edge. Port 54 allows fluid communication between inlet 42, vacuum chamber 48 and a vapor recovery line, as is more fully described below. As best seen in FIG. 4, port 54 is preferably a cylindrical bore that is threaded to allow body 36 to be coupled to a vapor recovery line. Port 54 thus extends from the exterior of body 36 inwardly to vacuum chamber 48. Inlet 42, port 46 and port 54 are all preferably axially aligned so that they share the same center line.

Section 52 extends vertically upwardly from section 50 and has generally the same depth as section 50. Extending from the exterior of body 36 into section 52 is a vapor inlet port 56 that is oriented perpendicularly to ports 42 and 54. Port 56 is preferably a cylindrical bore and is threaded to receive a vapor inlet line. Section 52 also has a vacuum switch channel 58 that extends from the upper-most end of section 52 to a vacuum switch port 60. Port 60 is a cylindrical threaded bore adjacent inlet 42 and parallel thereto. Vacuum switch 40 has a threaded portion thereon which allows switch 40 to be threaded into port 60. Port 60 and channel 58 thus allow switch 40 to communicate with vacuum chamber 48.

Vacuum-activated switch 40 is a switch that is activated upon the occurrence of changes in vacuum within a given location. Switch 40 can be electrically coupled to a control circuit that controls operation of the phase II recovery system, as is more fully described below.

Figure 7:
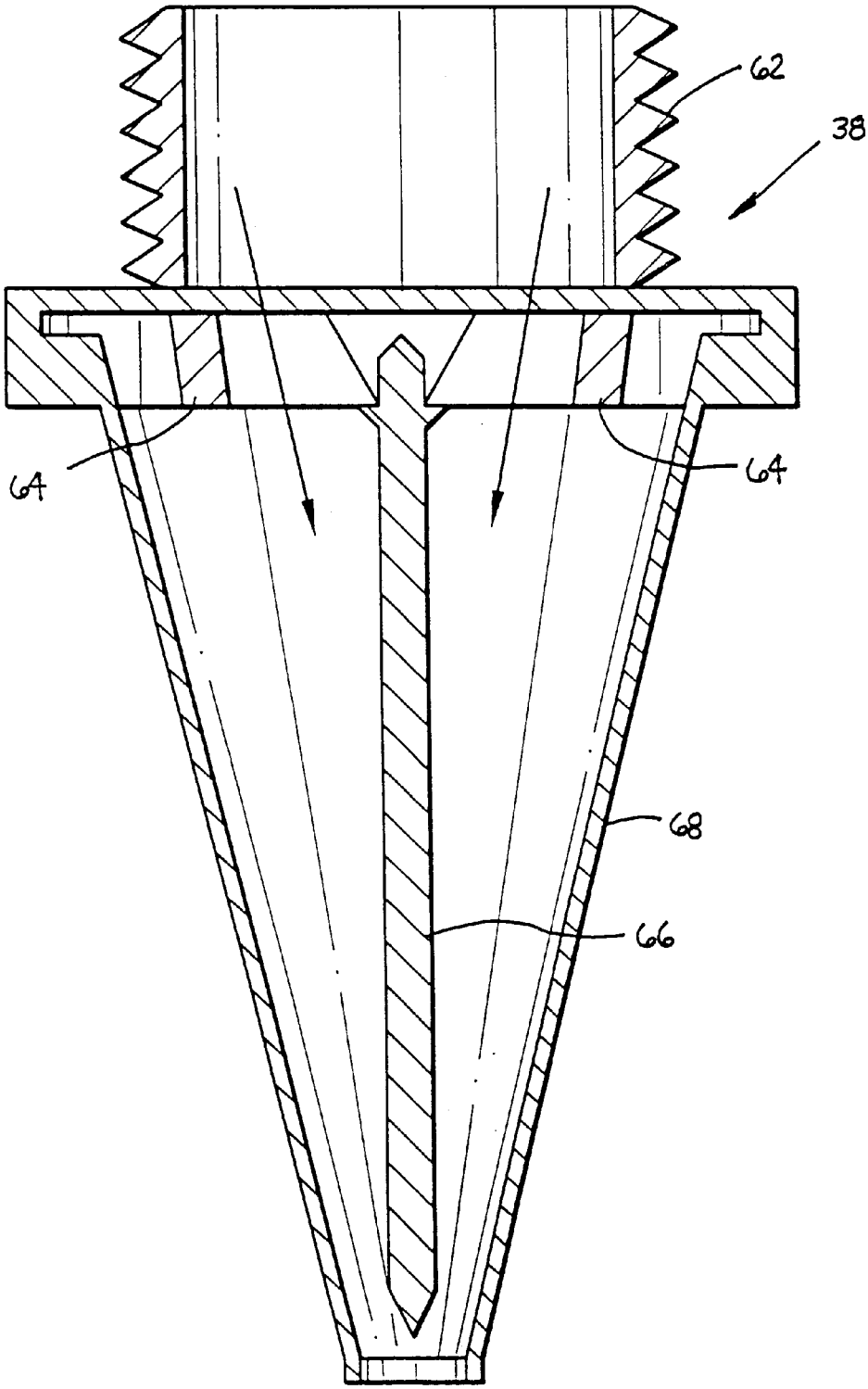
FIG. 7 is a cross-sectional view of the nozzle component of the detector of FIG. 4.

As described above, nozzle 38 is threaded into port 46. As best seen in FIG. 7, nozzle 38 has an upper threaded end 62, which is threaded to be matingly received within port 46. End 62 has an open interior that allows fluid to flow therethrough, and has, at its lower end, a number of angled fins 64. Preferably, three such fins 64 are provided and are equally spaced about the perimeter of the interior of end 62. Fins 64 are angled radially inwardly and are curved to impart a swirling motion to the fluid flowing thereover. Nozzle 38 is further equipped with a cylindrical center rod 66. Rod 66 is suspended within nozzle 38 and extends down the center line thereof. The swirling motion imparted on the fluid by fins 64 is further aided by rod 66. As best seen in FIG. 7, surrounding rod 66 below end 62 is a conical tip 68. Tip 68 is shaped as a truncated cone and has an opening at its lower end to allow fluid to flow through it. Rod 66 terminates just above the opening in tip 68. Tip 68 is dimensioned so that its lower end extends slightly into port 54 when nozzle 38 is threaded into port 46. When fluid is presented to inlet 42, it flows through body 36 by flowing through throat 44, nozzle 38 and port 54. The velocity of fluid exiting nozzle 38 will be increased by the nozzle. This increased velocity will lower the pressure within vacuum chamber 48, and will create a vacuum therein. This vacuum, along with switch 40 and vapor inlet port 56, when properly connected within a phase II vapor recovery system, allows sensor 34 to detect the presence of a vehicle equipped with an ORVR system.

Figure 5:
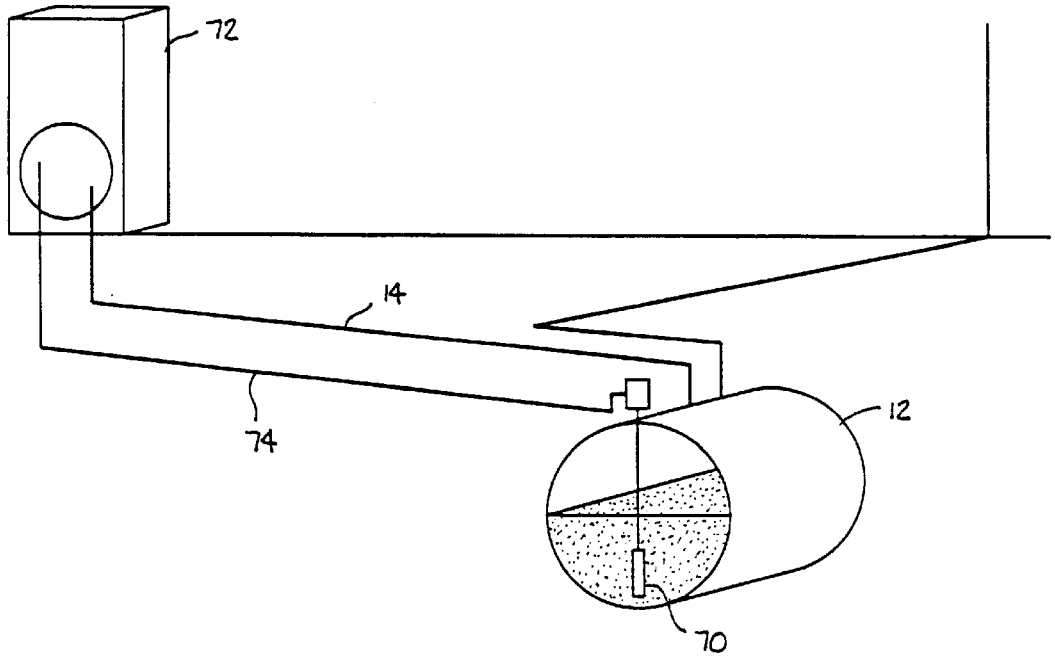
FIG. 5 is a schematic illustrating the environment and connection of the detector of FIG. 4.
Figure 6:
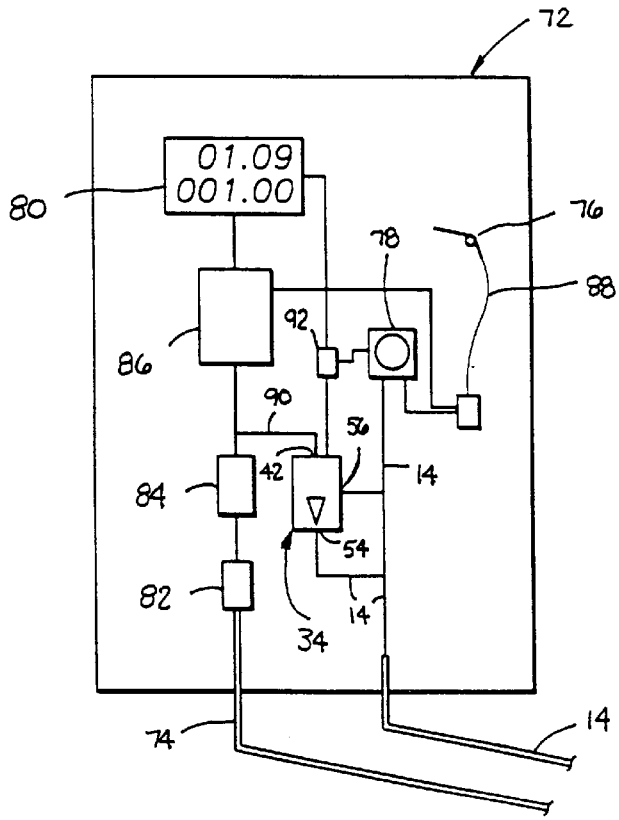
FIG. 6 is a schematic illustrating the environment and connection of the detector of FIG. 4.

In use, sensor 34 is installed in a fueling environment as best seen in FIGS. 5 and 6. In a typical gas station equipped with a phase II recovery system, the fuel is stored in an underground storage tank 12. Tank 12 is equipped with a pump motor 70 that is used to supply fuel to a dispenser 72 through a fuel line 74 when called for by the dispenser. In a phase II vapor recovery system, dispenser 72 will have a fuel dispensing nozzle 76. The hose from dispenser 72 to nozzle 76 is coaxial, with one line being used to deliver fuel to the vehicle, and the other line being used to return vapor from the vehicle's fuel tank. The phase II system has a vapor pump 78 that operates to draw vapor from the vehicle's fuel tank as new fuel is added to the tank. This vapor is routed back to storage tank 12 via a vapor return line 14.

Sensor 34 is coupled to dispenser 72 so that the signals from switch 40 control the operation of vapor pump 78. More specifically, dispenser 72 is equipped with a main central processing unit 80, as is known in the prior art. Incoming fuel from tank 12 is routed through line 74 to a shear valve 82 and a control valve 84. When valves 82 and 84 are open, fuel is allowed to travel through the system, and the amount of fuel delivered is measured by a meter 86. The fuel is delivered to a vehicle through coaxial hose 88. One line of hose 88 is used to deliver fuel to the vehicle. The fuel travels through hose 88 and nozzle 76 into the vehicle. As discussed above, in phase II systems, nozzle 76 is equipped to allow vapor from the vehicle fuel tank to be routed back to tank 12. This vapor travels back through the other line of hose 88 and is pumped back into tank 12 through line 14 by vapor pump 78.

Sensor 34 is tied into the above system by routing some of the fuel through sensor 34. A line 90 is coupled to inlet 42, connected to the system before meter 86. Thus, as fuel is allowed to flow through the system, a portion is routed through sensor 34. As described above, when fuel is routed through body 36, a vacuum is created in chamber 48. Outlet port 54 is coupled to vapor return line 14, thus routing the fuel passing through sensor 34 back into tank 12. Vapor inlet port 56 is also coupled to vapor return line 14, but is coupled upstream of port 54, as best seen in FIG. 6. Vacuum switch 40 is electrically connected to a control relay 92 that is connected to the CPU 80 and the vapor pump 78. Upon receiving a signal from switch 40, relay 92 will open the vapor pump 78 is adjusted accordingly. The location of sensor 34 is not critical, so long as fuel and vapor can be routed therethrough.

In use, when fuel is flowing through the system, a portion will be routed through sensor 34. This flow creates a vacuum within chamber 48, and the fuel is rerouted in a closed loop back to tank 12. When a non-ORVR equipped vehicle is refueling at a gas station having a phase II vapor recovery system in place, hydrocarbon vapor from the refueling vehicle's tank will be drawn back through nozzle 76 and hose 88 by vapor pump 78. Pump 78 will then return this vapor, along with the fuel routed through sensor 34, to tank 12. A portion of this hydrocarbon vapor is also routed through sensor 34 via vapor inlet port 56. However, when hydrocarbon vapor is being routed through sensor 34, it is allowed to mix with the hydrocarbon vapors present in chamber 48 and caused by nozzle 38. This returning vapor will thus not affect the vacuum level existing within chamber 48 and monitored by vacuum-activated switch 40. In this situation, relay 92 will remain open and vapor pump 78 is allowed to continue normal operation. Therefore, when a non-ORVR equipped vehicle is presented, the existing phase II vapor recovery system is allowed to operate as intended, and hydrocarbon vapor from the vehicle fuel tank is recaptured within tank 12.

When a vehicle equipped with an ORVR system is presented, vapor will not be allowed to be drawn from the vehicle tank and through the vapor return line 14, due to the design of ORVR systems. In this situation, a portion of the fuel that is flowing through the system will again be routed through sensor 34. This flow creates a vacuum within chamber 48, and the fuel is rerouted in a closed loop back to tank 12. However, unlike the situation presented with a non-ORVR vehicle, vapor cannot be returned to tank 12 from the vehicle. If vapor pump 78 is allowed to continue normal operation, air will be pumped back into tank 12 which is undesirable. When the ORVR equipped vehicle begins fueling, a portion of air will be routed through vapor return line 14 to sensor 34. This air is pumped with vapor pump 78 into port 56 and chamber 48. When air is introduced into chamber 48, it does not mix with the hydrocarbon vapor already present and caused by routing fuel through nozzle 38. The introduction of air will cause the pressure within chamber 48 to rise, lessening the vacuum present.

This pressure or vacuum difference is detected by switch 40 and will activate switch 40. Because this difference is caused by an ORVR equipped vehicle, it is desirable to adjust vapor pump 78 from normal operation to compensate for the presense of the ORVR vehicle. Relay 92 is coupled between switch 40 and vapor pump 78 so that when a vacuum difference is detected the relay will open and vapor pump 78 will adjust to compensate for the presence of the ORVR vehicle.

It can thus be seen that sensor 34 allows the presence of an ORVR-equipped vehicle to be almost immediately detected. This allows the phase II vapor recovery system to be selectively adjusted when an ORVR equipped vehicle is present. This prevents the introduction of air into tank 12 and prevents fugitive omissions from occurring.

From the foregoing, it will be seen that this invention is one well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus claimed the invention, what is claimed is:

1. An apparatus for detecting the presence of a vehicle equipped with an onboard refueling vapor recovery system, comprising:

a body having an inlet fluid port and an outlet fluid port in fluid communication with said inlet fluid port, said body further having an inlet vapor port in fluid communication with said outlet fluid port;

a vacuum chamber located within said body, said vacuum chamber being in fluid communication with said vapor port and said outlet port;

a vacuum-activated switch coupled to said body and operably connected to be in communication with said vacuum chamber; and a vacuum-generating nozzle coupled within said body between said inlet port and said vacuum chamber, wherein fuel may be provided to said inlet port and routed through said nozzle to create a vacuum within said chamber and wherein said vapor port may be coupled to a vapor return line, said switch being adjusted to detect the vacuum difference occurring when air is returned through said vapor port rather than fuel vapor.

2. The apparatus of claim 1, wherein said nozzle includes a plurality of angled fins coupled to the upper end of the nozzle, said fins imparting a swirling motion to fluid presented thereto.

3. The apparatus of claim 2, wherein said inlet port and said outlet port are in axial alignment.

4. The apparatus of claim 3, wherein said vapor port is oriented orthogonally relative to said inlet and said outlet ports.

5. The apparatus of claim 4, wherein said body has a nozzle port formed therein between said inlet port and said vacuum chamber, and wherein said nozzle is threaded into said nozzle port.

6. The apparatus of claim 5, wherein said vacuum-activated switch is electrically connected to a Phase II vapor recovery system vapor pump, said switch being connected to allow adjustment in the operating level of the vapor pump upon sensing of a change in vacuum level.

7. An apparatus for controlling operation of a Phase II vapor recovery system and for sensing the presence of a vehicle equipped with an onboard refueling vapor recovery system, comprising:

a body;

an inlet fluid port formed in said body;

a nozzle port formed in said body generally adjacent an interior end of said inlet port;

a vacuum chamber formed within said body, said chamber being adjacent said nozzle port and in fluid communication with said inlet and said nozzle ports;

a vacuum-generating nozzle coupled within said body and within said nozzle port, said nozzle having a truncated conical portion extending away from said nozzle port;

an outlet fluid port formed in said body and extending from said vacuum chamber to the exterior of said body;

an inlet vapor port formed in said body and extending from said vacuum chamber to the exterior of said body;

a vacuum-activated detecting switch coupled to said body to be in communication with said vacuum chamber, and electrically connected to the Phase II vapor recovery system, wherein fuel may be provided to said inlet port and routed through said nozzle to create a vacuum within said chamber and wherein said vapor port may be coupled to a vapor return line of the Phase II vapor recovery system, said switch being adjusted to detect the vacuum difference occurring when air is returned through said vapor port rather than fuel vapor.

8. The apparatus of claim 7, wherein said nozzle includes a plurality of angled fins coupled to the upper end of the nozzle, said fins imparting a swirling motion of fluid presented thereto.

9. The apparatus of claim 8, wherein said nozzle has a truncated conical portion with a center rod extending axially with the conical portion.

10. The apparatus of claim 8, wherein said inlet port and said outlet port are in axial alignment.

11. The apparatus of claim 10, wherein said vapor port is oriented orthogonally relative to said inlet and said outlet ports.

12. The apparatus of claim 11, wherein said vacuum-activated switch is electrically connected to a vapor pump of the Phase II vapor recovery system, said switch being connected to interrupt operation of the vapor pump upon sensing of a predetermined change in vacuum level.

* * * * *